US008438678B2

(12) United States Patent
Brottlund et al.

(10) Patent No.: US 8,438,678 B2
(45) Date of Patent: May 14, 2013

(54) BEDDING FOUNDATION HAVING CORNER GUARDS AND MULTIPLE PIECE BORDER

(75) Inventors: Von W. Brottlund, Pierce City, MO (US); John J. Brunnert, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 91 days.

(21) Appl. No.: 13/082,848

(22) Filed: Apr. 8, 2011

(65) Prior Publication Data

US 2012/0255119 A1 Oct. 11, 2012

(51) Int. Cl.
*A47C 23/02* (2006.01)

(52) U.S. Cl.
USPC ..... 5/247; 5/261; 5/254; 5/260; 5/717

(58) Field of Classification Search ..... 5/254, 717, 5/261, 260, 262, 263, 739
See application file for complete search history.

(56) References Cited

U.S. PATENT DOCUMENTS

| | | | | |
|---|---|---|---|---|
| 5,052,064 | A | 10/1991 | Hagemeister et al. | |
| 6,493,887 | B1 | 12/2002 | DeFranks et al. | |
| 6,687,929 | B2 | 2/2004 | DeFranks et al. | |
| 7,805,780 | B2 | 10/2010 | Davis et al. | |
| 8,020,224 | B2 * | 9/2011 | Turnbull | 5/254 |

* cited by examiner

*Primary Examiner* — Robert G Santos
*Assistant Examiner* — Brittany Wilson
(74) *Attorney, Agent, or Firm* — Wood, Herron & Evans, LLP

(57) ABSTRACT

A bedding foundation has a wire core which may be nestably stacked with numerous other such assemblies for transportation, thereby avoiding the need to compress and tie multiple assemblies for shipping. The wire core which includes an upper wire grid made of four distinct border wires and support wires extending between two opposing border wires. Each support wire has flattened valleys below the plane of the upper wire grid, each flattened valley being adapted to be secured to a wooden base frame. The wire cores, wooden bases and corner guards may be shipped separately.

20 Claims, 6 Drawing Sheets

BEDDING FOUNDATION HAVING CORNER GUARDS AND MULTIPLE PIECE BORDER

FIELD OF THE INVENTION

This invention relates generally to a bedding products and more particularly to a bedding foundation and the process of making the foundation.

BACKGROUND OF THE INVENTION

Bedding foundations or so-called box spring assemblies generally comprise a wooden base, an upper grid and a plurality of coil or bent wire spring modules extending between the wire grid and the wooden base. The coil or bent wire modules are welded or otherwise secured to an upper wire grid and stapled or otherwise secured to the base. As thus manufactured, these box spring assemblies are bulky. Shipping such assemblies to a manufacturer for application of padding and covering may be costly. In order to reduce shipping space requirements, it is customary to compress the box spring assemblies to reduce their individual thicknesses and, when compressed, to tie them in their compressed state. This involves providing presses and ties which are expensive, and the extra operations of pressing and tying the assemblies. At the delivery end, the manufacturer must cut and discard the ties before applying the covering. These additional material and handling costs increase the end cost of box spring assemblies U.S. Pat. No. 5,052,064 discloses a nestably stackable bedding foundation assembly which overcomes the manufacturing and shipping problems characteristic of the more traditional coil or modular box springs or bedding foundations. The bedding foundation assembly of U.S. Pat. No. 5,052,064 comprises a rectangular border wire and transversely spaced, parallel and longitudinally extending support wires parallel to the border wire sides and having ends connected to the border wire ends. These support wires are generally corrugated along their lengths, having peaks and valleys with the peaks being generally co-planar with the plane defined by the border wire and the valleys being displaced beneath and intermediate of the peaks. Longitudinally spaced, parallel and transversely extending upper connector wires, parallel to the border wire ends, are connected along their lengths to the peaks of the support wires. The valleys of the support wires are stapled to the wooden base upon assembly. The longitudinal voids between the peaks of the support wires are of a greater dimension than the valleys of the support wires. This configuration enables one nestably stackable bedding foundation assembly to be nestably stacked atop a second assembly since the support wire valleys of the first assembly may enter into the voids between the peaks of the support wires of the second assembly. Such a nestably stacked arrangement results in a total height dimension which is less than the sum of the individual assembly height dimensions.

One advantage of the bedding foundation assembly of U.S. Pat. No. 5,052,064 is that it enables relatively inexpensive bedding foundation wire cores to be tightly compacted and shipped in a minimum of space to an assembly destination, thereby reducing the ultimate cost of the bedding foundation to the assembler and ultimately to the customer. The bedding foundation of U.S. Pat. No. 5,052,064 also may be rapidly loaded by a manufacturer for transportation to the destination of assembly without the need for compressing and tying box spring assemblies. The same is true of the bedding foundation disclosed in U.S. Pat. No. 7,805,780.

In certain applications, one may desire a box spring or bedding foundation having corner guards which provide the foundation a smooth appearance at the corners. Bedding foundations having such corner guards are disclosed in U.S. Pat. Nos. 6,493,887 and 6,687,929. One drawback to these corner guards is that they are not secured to the upper border wire of the foundation. Therefore, the corner guards may partially or totally separate from the remainder of the foundation and lessen the appearance of the foundation.

Accordingly, there is a need for a bedding foundation which has corner guards secured to an upper border of the foundation.

There is further a need for a process for manufacturing a foundation having corner guards which may be shipped with its components in stacks and assembled at its destination.

SUMMARY OF THE INVENTION

The present invention is directed to a bedding foundation or box spring comprising nestably stackable components which has advantages of the bedding foundations disclosed in U.S. Pat. Nos. 5,052,064 and 7,805,780, each of which is fully incorporated by reference herein. However, the bedding foundation of the present invention has an additional advantage, corner guards for improving the appearance of the foundation.

According to one aspect of the invention, the foundation comprises a base and four corner guards secured to the base. The foundation further comprises a nestably stackable wire assembly comprising a pair of end border wires, each of the end border wires being secured to two of the corner guards and a pair of side border wires, each of the side border wires being secured to two of the corner guards. The nestably stackable wire assembly further comprises a plurality of spaced support wires extending between the end border wires and secured to the end border wires. Each of these support wires has flattened peaks and flattened valleys with the peaks being generally co-planar and in the plane of the border wire and the valleys being displaced beneath and intermediate of the peaks. In addition, the nestably stackable wire assembly may further comprise multiple parallel connector wires extending perpendicular to the general direction of the support wires, the connector wires being generally in the plane of the border wires. These connector wires are fixedly attached at their opposite ends to the side border wires and are attached intermediate of their ends to the peaks of the support wires. The nestably stackable wire assembly may be secured to the base.

The foundation further comprises four corner guards secured to the base with staples and secured in a snap fit manner to the border wires of the multiple piece border.

In addition, the foundation may include padding or cushioning material overlying the nestably stackable assembly and a fabric or upholstered covering encasing the padding, the nestably stackable assembly, corner guards and base.

According to another aspect of the invention, the foundation comprises a base comprising a rectangular frame and slats. The foundation further comprises a plurality of support wires stapled to the base, two side border wires of the same length and two end border wires of the same length. The foundation further comprises four corner guards secured to the base, each of the side border wires being secured to two of the corner guards and each of the end border wires being secured to two of the corner guards.

According to another aspect of the invention, the foundation comprises a base and a nestably stackable wire assembly and four corner guards. The nestably stackable wire assembly includes two straight side border wires, two straight end border wires and support wires extending from one of the end border wires to the other end border wire. The support wires are secured to the base. The nestably stackable wire assembly further comprises connector wires secured to the support wires and extending from one of the side border wires to the other side border wire. The foundation further comprises corner guards secured to the base and two of the border wires, each of the corner guards extending between the base and two of the border wires.

The foundation of the invention provides attractive looking corners while still providing a foundation which may be shipped as components, as opposed to fully assembled. These and other advantages of the present invention will more readily become apparent from the description of the drawings herein, in which:

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
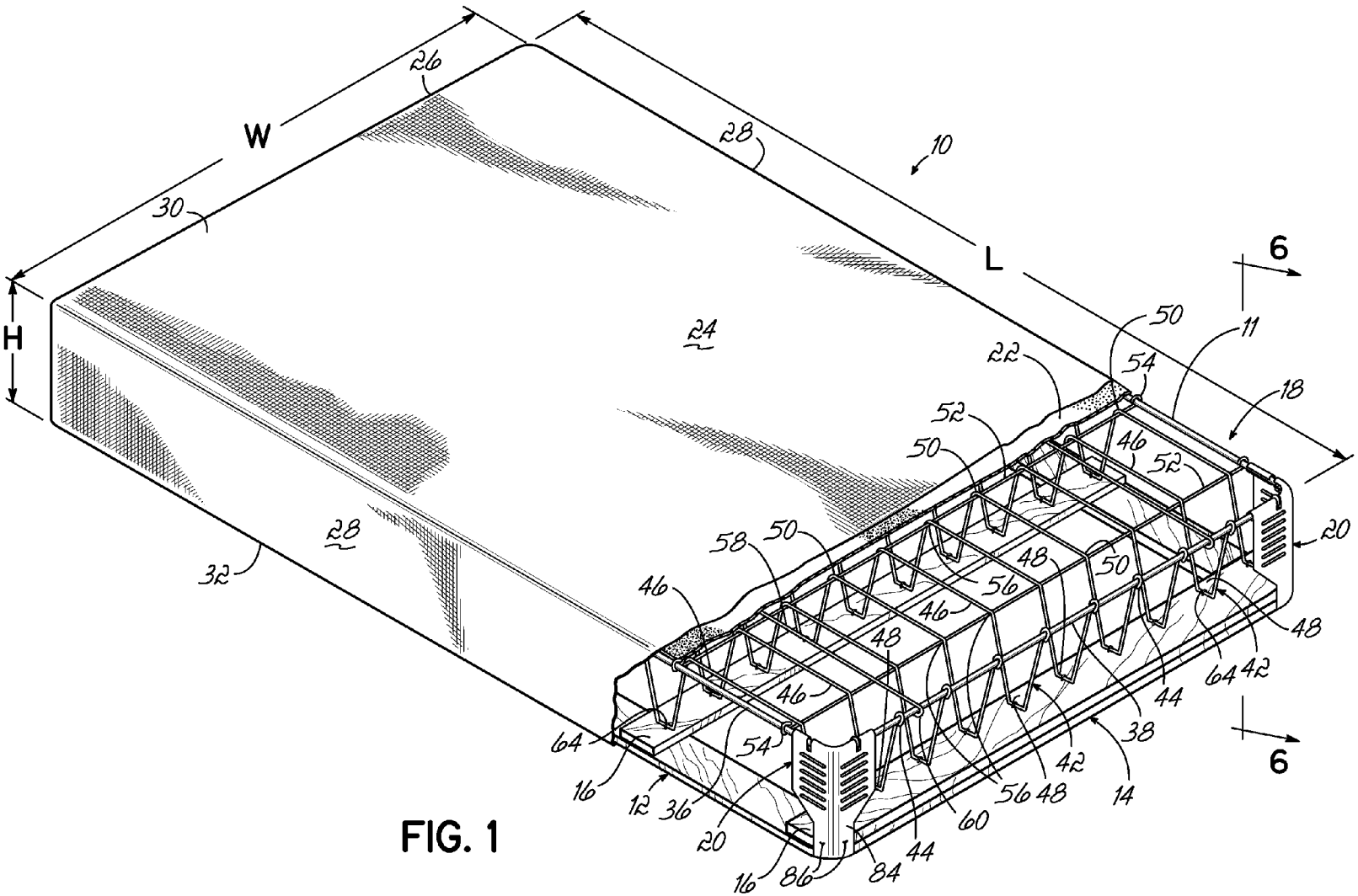
FIG. 1 is a perspective view, partially broken away, of a bedding foundation embodying one aspect of the invention.

Referring to FIG. 1, an assembled bedding foundation 10 is illustrated. The foundation 10 has a rectangular wooden base 12, including a rectangular frame 14 on which are attached transverse wooden slats 16. The base is not intended to be limited to wood; it may be any desired material including plastic. Atop these transverse slats 16 is the nestably stackable assembly or wire core 18. Four corner guards 20 (only two being shown in FIG. 1) are secured to both the base 12 and nestably stackable assembly 18 and extend therebetween. Padding or cushioning material 22, which may be foam, fiber or any like material or combination thereof, overlies the nestably stackable assembly 18. A fabric or upholstered covering 24 surrounds the nestably stackable assembly 18, the corner guards 20, padding 22 and base 12.

As shown in FIG. 1, the foundation 10 has a pair of opposed end surfaces 26, the linear distance between which defines a length or longitudinal dimension "L" of the foundation 10. The foundation 10 also has a pair of opposed side surfaces 28, the linear distance between which defines a width or transverse dimension "W" of the foundation 10. In addition, the foundation 10 has an upper surface 30 and a lower surface 32, the linear distance between which defines a height dimension "H" of the foundation 10. Although, the length is shown as being longer than the width, they may be the same length. The drawings are merely for illustration purposes and do not intend to limit these dimensions.

Figure 3:
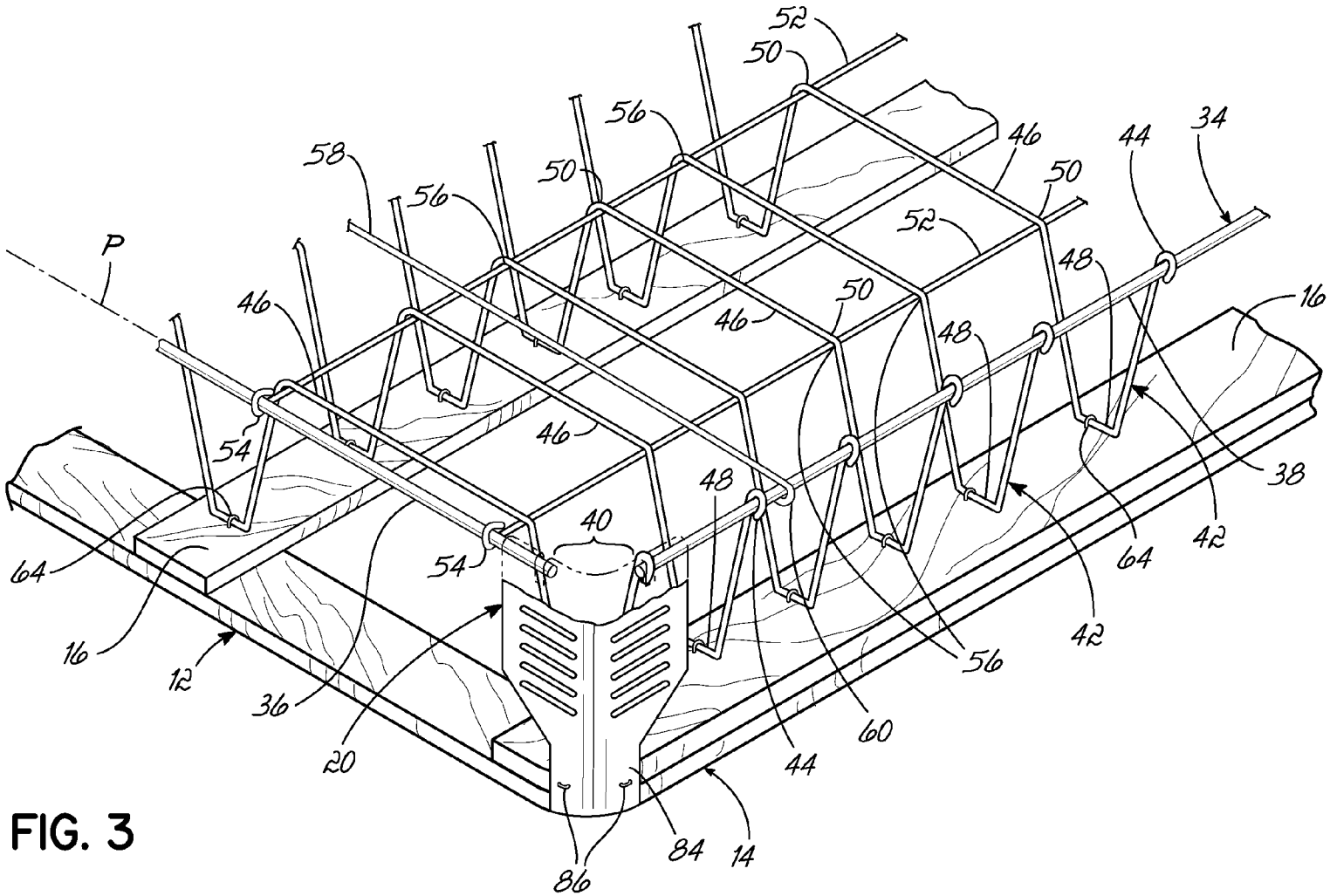
FIG. 3 is an enlarged perspective view of a portion of the bedding foundation of FIG. 1 with the corner guard partially removed.
Figure 4:
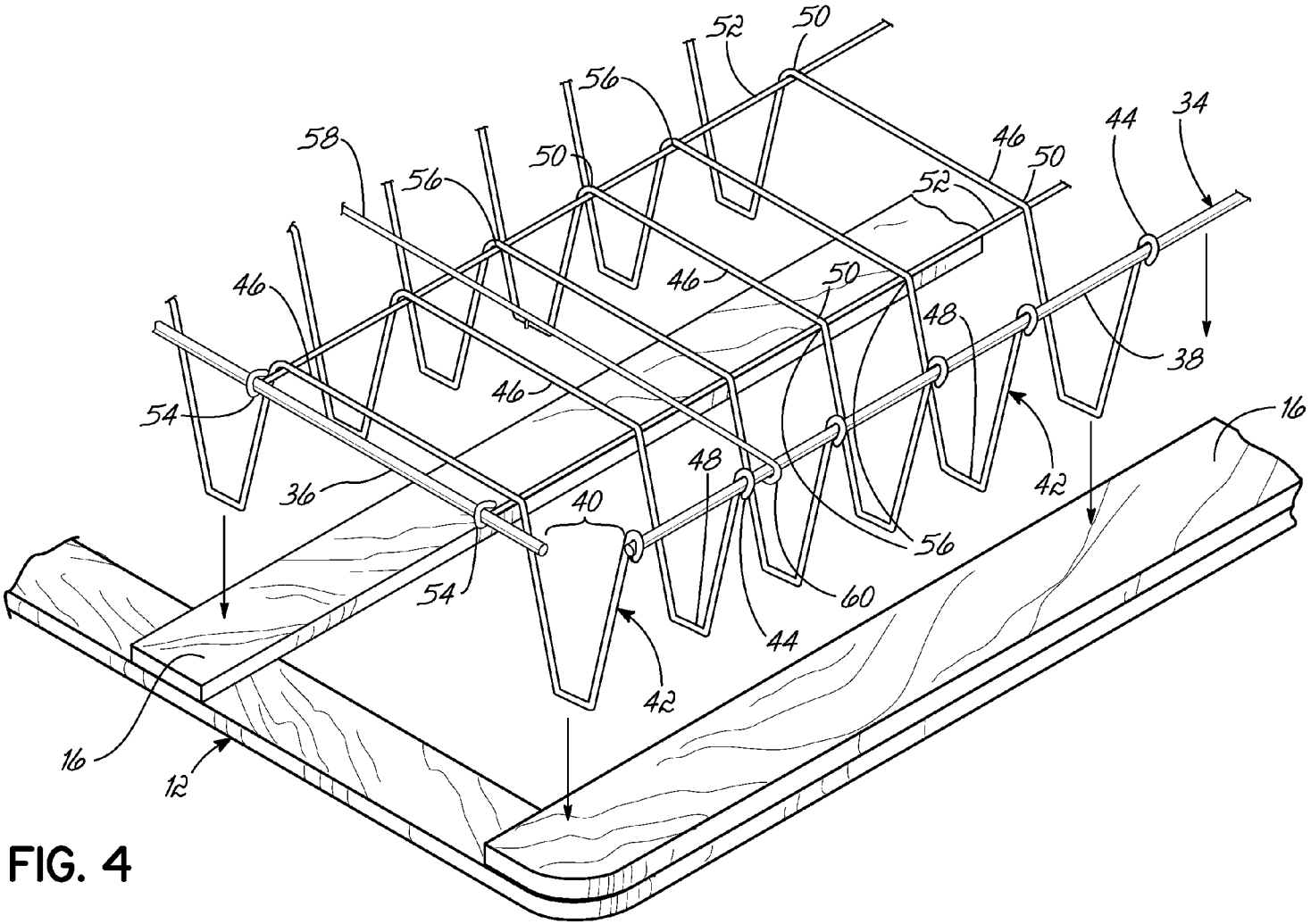
FIG. 4 is an enlarged perspective view of a corner of the bedding foundation of FIG. 1.

As best shown in FIGS. 3 and 4, nestably stackable assembly 18 comprises a rectangular steel border 34 comprising two parallel side border wires 36 (only one being shown) and two parallel end border wires 38 (only one being shown) with gaps 40 between one of the side border wires 36 and one of the end border wires 38. The parallel side border wires 36 are shown being longer than the parallel end border wires 38. However, they may be any desired length including the same length. These border wires 36, 38 are shown as having a round cross-sectional configuration. However, they (either or both) may have any desired cross-sectional configuration including a rectangular cross-sectional configuration as disclosed in U.S. patent application Ser. No. 12/821,559, which is fully incorporated by reference herein.

Transversely spaced and longitudinally extending support wires 42 extend from end-to-end of the nestably stackable assembly 18 and have ends 44 which are crimped or wrapped around and/or welded to the end border wires 38 of the border 34. As seen in FIG. 3, each support wire 42 is formed so as to have a generally corrugated shape along its length including a plurality of spaced flattened peaks 46 and flattened valleys 48. These flattened peaks 46 are generally co-planar with the plane P defined by the border 34 (see FIG. 3), with the flattened valleys 48 being vertically spaced beneath and intermediate of the flattened peaks 46. The length of each flattened peak 46 is preferably identical and defined between locations 50.

Longitudinally spaced, parallel and transversely extending steel upper connector wires 52 extend parallel to the end border wires 38 and have ends 54 which are crimped around and/or welded to the side border wire 36. These upper connector wires 52 are welded intermediate of their ends 54 along their lengths at locations 56 to the flattened peaks 46 of the support wires 42. Although the drawings of the nestably stackable assembly 18 of the illustrated embodiment show two spaced upper connector wires 52 welded to each flattened peak 46 of each support wire 42, any number of such upper connector wires may be connected or welded to each flattened peak 46 of each support wire 42.

Similarly, transversely spaced, parallel and longitudinally extending upper supplemental wires 58 extend parallel to the border wire sides 36 and have ends 60 which are crimped around and/or welded to the end border wires 38. These upper supplemental wires 58 are welded intermediate of their ends 60 along their lengths at locations 62 (see FIG. 2) to the upper connector wires 52. Although the drawings of the nestably stackable assembly 18 shows two spaced upper supplemental wires 58 in the nestable stackable wire core 18, any number of such wires may be used. Alternatively, the nestably stackable assembly 18 may have no upper supplemental wires.

Figure 2:
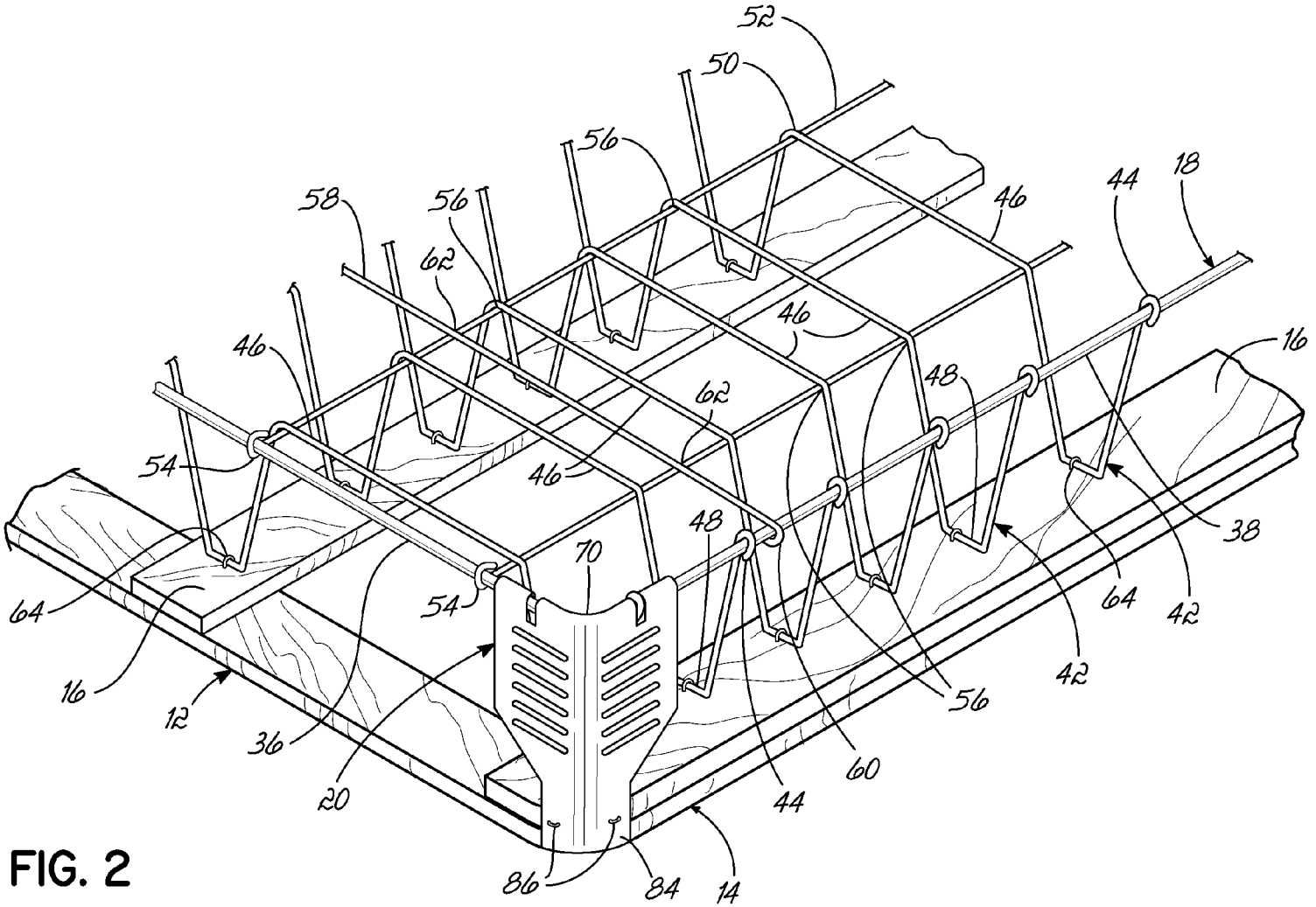
FIG. 2 is an enlarged perspective view of a portion of the bedding foundation of FIG. 1.
Figure 6:
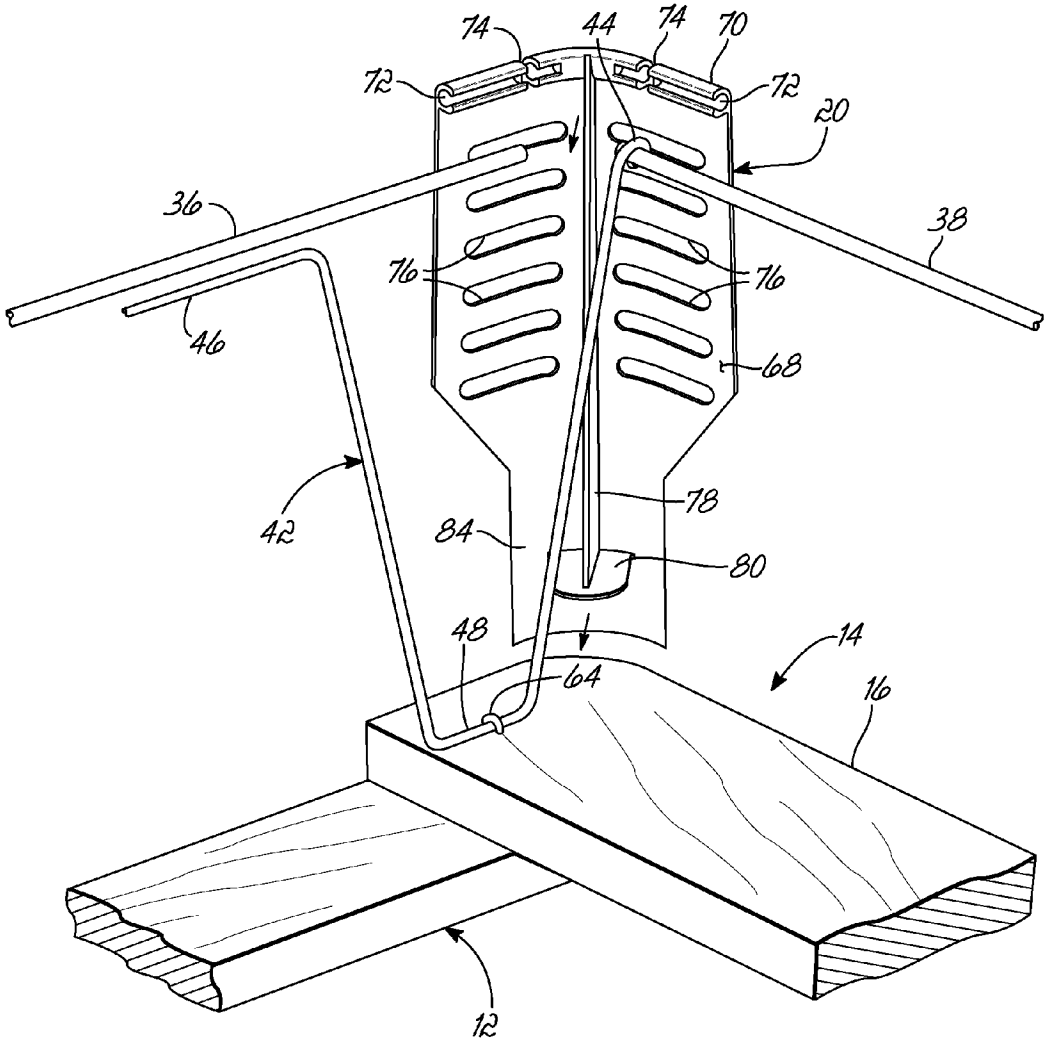
FIG. 6 is a perspective view of a portion of the bedding foundation of FIG. 1 showing the inside of a corner guard.
Figure 5:
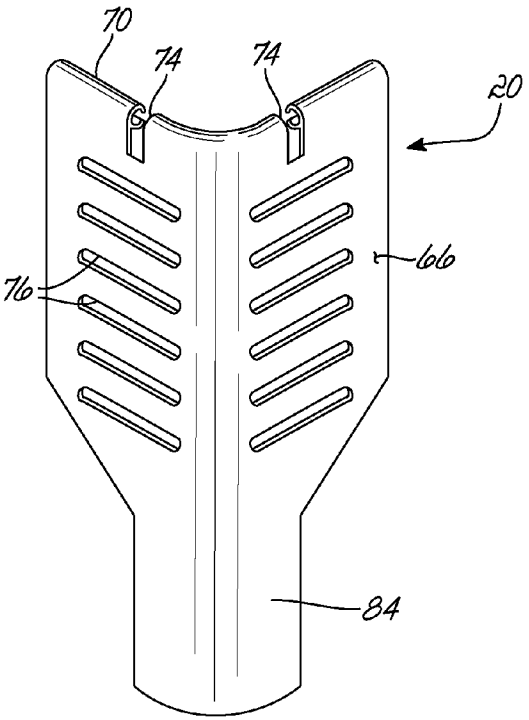
FIG. 5 is a perspective view of one of the corner guards.

The foundation 10 further comprises four corner guards 20 (only two being shown in FIG. 1). The corner guards are typically made of plastic; however, they may be any desired material including metal. Although one configuration of corner guard 20 is illustrated, the invention does not intend to limit the material, size, shape or configuration of corner guard. As best illustrated in FIGS. 5 and 6, each corner guard 20 has a convex outer surface 66 and a concave inner surface 68. Each corner guard 20 has a rounded upper portion 70 which is generally C-shaped in cross-section. The rounded upper portion 70 has a pair of receptacles 72, each of which is sized and configured to receive and retain one of the border wires 36, 38. Preferable, each of the border wires 36, 38 may be snapped into one of the receptacles 72 of the corner guard 20, as shown in FIG. 6. The upper portion 70 of each corner guard 20 has a pair of slots 74 adapted to receive an end 44 of one of the support wires 42 to ensure a proper fit with the corner guard 20 in its correct location. Each corner guard 20 also has a plurality of vertically spaced openings 76 which function to reduce the weight of the corner guard 20 without comprising its functionality which is to give a rounded appearance to the foundation after the foundation is upholstered or covered in fabric. Referring to FIG. 6, each corner guard 20 further comprises a center rib 78 and a locator 80, both extending inwardly from the inner surface 68 of the corner guard 20. The locator 80 is adapted to rest on top of the outermost slat 16 of base 12 to ensure the corner guard 20 is located in its intended position. The rib 78 extends from the upper portion 70 of the corner guard 20 to the locator 80, as shown in FIG. 6. As best shown in FIG. 2, each corner guard 20 has a bottom portion 84 which is narrower than the remainder of the corner guard 20. This bottom portion 84 is stapled with two staples 86 to the base 12 upon assembly, as shown in FIGS. 2 and 3.

In the embodiment of foundation 10 illustrated, each support wire 42 comprises a flattened valley 48 which is parallel the side border wires 36 and is secured to the slats 16 of the base 12 with at least one staple 64. Any number of staples or any other fastener may be used to secure the flattened valleys 48 of the support wires 42 to the base 12 in any embodiment described herein.

The nestably stackable wire core assembly 18 of the bedding foundation 10 is generally manufactured by a supplier, who stacks a plurality of like assemblies, then ships such stack to an assembler. The assembler lifts one of the wire core assemblies from the stack, attaches the corner guards 20 to the wire core assembly 18 and staples or secures it, along with the corner guards 20 to wooden base 12. He/she then adds the padding 22 and upholstery 24 to make a completed product or foundation 10.

Figure 7:
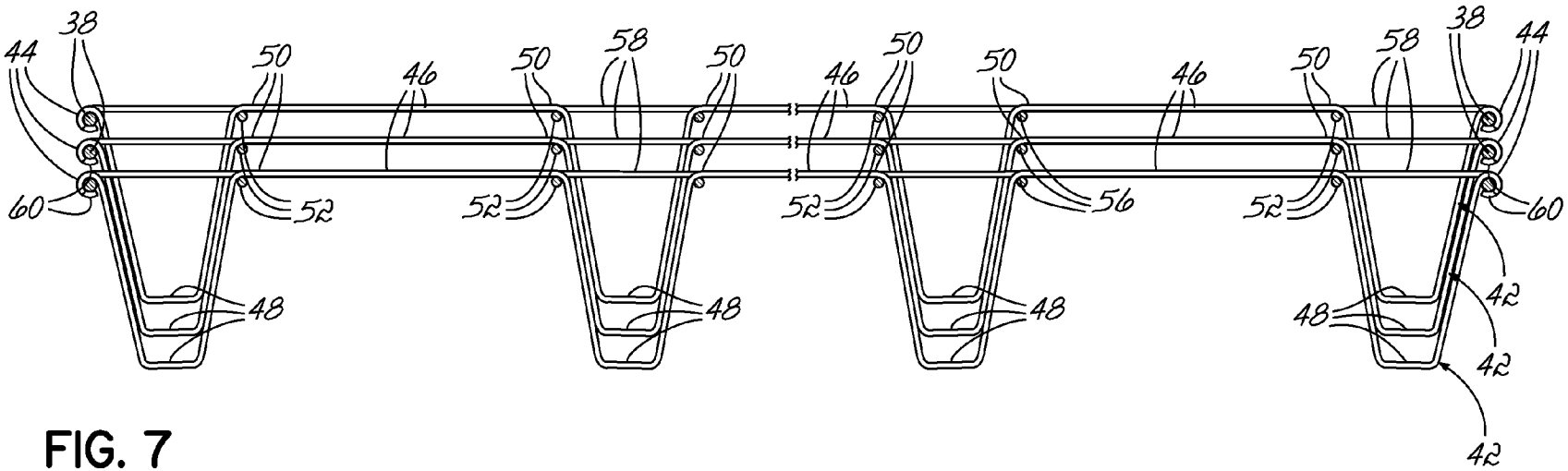
FIG. 7 is a side elevational view of three nestably stacked wire cores.

The present invention facilitates shipment of the wire core assemblies 18 by a supplier to an assembler. With reference to FIG. 7, it will be seen that a first stackable assembly or core 18 may be placed upon a surface with the valleys 48 of the support wires 42 oriented downwardly and the flattened peaks 46 of the support wires 42 oriented upwardly. Next, a second like assembly 18 may be placed atop the first assembly 18, with its support wire valleys 48 and flattened support wire peaks 46 likewise oriented downwardly and upwardly, respectively. The flattened valleys 48 of the second assembly 18 are thereby allowed to enter into the voids or pockets 82 between the flattened peaks 46 of the support wires 42 of the first assembly 18. The second assembly 18 nestles downwardly within the first assembly 18 until the outside dimension of the flattened valleys 48 of the second assembly 18 is equal to the inside dimension of the flattened valleys 48 of the first assembly 18. At this point, the second assembly 18 comes to rest within the first assembly 18, with the overall height of the nested assemblies being substantially less than the sum of the individual heights of the assemblies. Although FIG. 7 shows a stack of three wire core assemblies 18, any number of wire core assemblies may be nested and stacked together for storage or shipment.

In order to assemble foundation 10, the base 12 is secured with staples 64 (only a few being shown) to one of the nestably stackable wire core assemblies 18. More particularly, the flattened valleys 48 of the support wires 42 of the nestably stackable wire core assembly 18 are stapled to the slats 16 of the base 12.

While we have described several embodiments of our invention, those persons skilled in the art will readily recognize modifications and changes which may be made without departing from the spirit or scope of the invention. For example, any of the foundations described or illustrated herein may incorporate alternatively shaped support wires as described herein. Accordingly, we intend for our invention to be limited only by the following claims:

We claim:

1. A bedding foundation comprising:
a base;
four corner guards secured to the base;
a pair of end border wires, each of the end border wires being secured to two of the corner guards;
a pair of side border wires, independent from the end border wires, each of the side border wires being secured to two of the corner guards;
a plurality of spaced support wires extending between said end border wires and secured to the end border wires;
cushioning material; and
an upholstered covering.

2. The foundation of claim 1 wherein the side border wires are longer than the end border wires.

3. The foundation of claim 1 wherein each of the side border wires is snapped into engagement with two of the corner guards.

4. The foundation of claim 1 wherein each of the each of the end border wires is snapped into engagement with two of the corner guards.

5. The foundation of claim 1 wherein the base is wooden.

6. The foundation of claim 1 wherein the corner guards are made of plastic material.

7. The foundation of claim 1 wherein the corner guards are stapled to the base.

8. The foundation of claim 1 wherein each of the support wires has a plurality of flattened peaks and a plurality of flattened valleys.

9. The foundation of claim 1 wherein each of the corner guards has a locator flange.

10. A bedding foundation comprising:
a base comprising a rectangular frame and slats;
a plurality of support wires secured to the base;
two side border wires of the same length;
two end border wires of the same length, with gaps between one of the side border wires and one of the end border wires; and
four corner guards secured to the base, each of the side border wires being secured to two of the corner guards and each of the end border wires being secured to two of the corner guards.

11. The foundation of claim 10 wherein the end border wires and side border wires are snapped into receptacles in the corner guards.

12. The foundation of claim 10 wherein each of the corner guards has a locator flange.

13. The foundation of claim 10 wherein each of the corner guards has openings.

14. The foundation of claim 10 wherein the corner guards are stapled to the base.

15. The foundation of claim 10 wherein each of the support wires has a generally corrugated shape.

16. A bedding foundation comprising:
a base;
two straight side border wires and two straight end border wires with gaps between one of the side border wires and one of the end border wires;
support wires extending from one of the end border wires to the other end border wire, said support wires being stapled to the base;
connector wires secured to the support wires and extending from one of the side border wires to the other side border wire; and corner guards secured to the base, each of the corner guards extending between and secured to two of the border wires.

17. The foundation of claim 16 wherein the side border wires are longer than the end border wires.

18. The foundation of claim 16 wherein each of the support wires has flattened peaks welded to the connector wires.

19. The foundation of claim 16 wherein the support wires are resilient.

20. The foundation of claim 16 wherein the support wires are generally corrugated in shape.

* * * * *